US005873916A

United States Patent [19]

Cemenska et al.

[11] Patent Number: 5,873,916

[45] Date of Patent: Feb. 23, 1999

[54] FUEL EMULSION BLENDING SYSTEM

[75] Inventors: Richard A. Cemenska, Edelstein; Gerald N. Coleman; Carlos H. Cortes, both of Peoria; Ed Jakush, Evanston; Ted. W. Scheuermann, Peoria, all of Ill.

[73] Assignee: Caterpillar Inc., Peoria, Ill.

[21] Appl. No.: 24,916

[22] Filed: Feb. 17, 1998

[51] Int. Cl.[6] ..... C10L 1/32

[52] U.S. Cl. ..... 44/301; 123/25 R

[58] Field of Search ..... 123/1 A, 25 R, 123/25 C, 25 E; 44/301

[56] References Cited

U.S. PATENT DOCUMENTS

| | | | |
|---|---|---|---|
| 4,563,982 | 1/1986 | Pischinger et al. | 123/1 A |
| 4,832,701 | 5/1989 | Polanco et al. | 44/301 |
| 4,983,606 | 1/1991 | Kunz | 366/134 |
| 5,000,757 | 3/1991 | Puttock et al. | 44/301 |
| 5,298,230 | 3/1994 | Argabright et al. | 423/239.1 |
| 5,344,306 | 9/1994 | Brown et al. | 431/4 |
| 5,419,852 | 5/1995 | Rivas et al. | 252/312 |
| 5,469,830 | 11/1995 | Gonzalez | 123/515 |
| 5,503,772 | 4/1996 | Rivas et al. | 252/314 |
| 5,535,708 | 7/1996 | Valentine | 123/25 |
| 5,584,894 | 12/1996 | Peter-Hoblyn et al. | 44/301 |
| 5,603,864 | 2/1997 | Silva et al. | 44/301 |

FOREIGN PATENT DOCUMENTS

| | | | |
|---|---|---|---|
| 2835099 | 1/1979 | Germany | 25/2 |

*Primary Examiner*—John T. Kwon
*Attorney, Agent, or Firm*—Robert J. Hampsch

[57] ABSTRACT

A fuel emulsion blending system and method for operating the same is provided. The disclosed embodiments of the fuel emulsion blending system includes a plurality of fluid circuits, including a hydrocarbon circuit, a fuel emulsion additive circuit, a water circuit and an optional alcohol/methanol circuit. Each of the inlet circuits are adapted for receiving the identified ingredient from a suitable source which optionally may be included as part of the blending system. The disclosed blending system further includes a first blending station adapted to mix the hydrocarbon fuel and fuel emulsion additives and a second blending station adapted to mix the hydrocarbon fuel and additive mixture received from the first blending station together with the water received from the source of water. The disclosed blending system further includes an emulsification station downstream of the blending stations which is adapted to emulsify the mixture of hydrocarbon fuel, additives and water to yield a stable fuel emulsion.

24 Claims, 3 Drawing Sheets

FUEL EMULSION BLENDING SYSTEM

FIELD OF THE INVENTION

The present invention relates to a fuel blending system, and more particularly to a fuel emulsion blending system for blending an aqueous fuel emulsion from a source of hydrocarbon fuel, a source of water, and a source of aqueous fuel emulsion additives.

BACKGROUND

Recent fuel developments have resulted in a number of aqueous fuel emulsions comprised essentially of a carbon based fuel, water, and various additives such as lubricants, emulsifiers, surfactants, corrosion inhibitors, cetane improvers, and the like. These aqueous fuel emulsions may play a key role in finding a cost-effective way for internal combustion engines including, but not limited to, compression ignition engines (i.e. diesel engines) to achieve the reduction in emissions below the mandated levels without significant modifications to the engines, fuel systems, or existing fuel delivery infrastructure.

Advantageously, aqueous fuel emulsions tend to reduce or inhibit the formation of nitrogen oxides (NOx) and particulates (i.e. combination of soot and hydrocarbons) by altering the way the fuel is burned in the engine. Specifically, the fuel emulsions are burned at somewhat lower temperatures than a conventional fuels due to the presence of water. This, coupled with the realization that at higher peak combustion temperatures, more NOx are typically produced in the engine exhaust, one can readily understand the advantage of using aqueous fuel emulsions.

A major concern of aqueous fuel emulsions or water blend fuels, however, is the stability of the fuel. As is well known in the art, the constituent parts of such aqueous fuel emulsions have a tendency to separate over time. Blending of the fuel emulsions in a manner to achieve long-term stability is essential if such fuels are to be commercially successful. The problems associated with fuel emulsion separation are very severe inasmuch as most engine operating characteristics are adjusted for a prescribed fuel composition. Where the fuel emulsion composition has changed due to ingredient separation, the engine performance is markedly diminished.

Several related art references have disclosed various devices or techniques for producing or blending a fuel emulsion for internal combustion engines. For example, U.S. Pat. No. 5,535,708 (Valentine) discloses a process for forming an emulsion of an aqueous urea solution in diesel fuel and combusting the same for the purposes of reducing NOx emissions from diesel engines. See also U.S. Pat. No. 4,938,606 (Kunz) discloses an apparatus for producing an emulsion for internal combustion engines that employs an oil line, a water line, a dosing apparatus and various mixing and storage chambers. Another related art process and system for blending a fuel emulsion is disclosed in U.S. Pat. No. 5,298,230 (Argabright) which discloses a specialized process for blending a fuel emulsification system useful for the reduction of NOx in a gas turbine.

The present invention addresses the aforementioned problems associated with separation of aqueous fuel emulsions by providing a blending system and method that enhances the long term stability of such emulsions.

SUMMARY OF THE INVENTION

The present invention is a fuel emulsion blending system for blending an aqueous fuel emulsion from a source of hydrocarbon fuel, a source of water, and a source of aqueous fuel emulsion additives. Advantageously, the blending system enhances the long term stability of such aqueous fuel emulsions over that of conventional blending systems.

The present invention may be characterized as a fuel emulsion blending system including a first inlet circuit adapted for receiving hydrocarbon fuel from the source of hydrocarbon fuel; a second inlet circuit adapted for receiving aqueous fuel emulsion additives from the source of aqueous fuel emulsion additives; and a third inlet circuit adapted for receiving water from the source of water. The blending system further includes a first blending station adapted to mix the hydrocarbon fuel and aqueous fuel emulsion additives and a second blending station adapted to mix the hydrocarbon fuel and additive mixture received from the first blending station together with the water received from the source of water. This system is particularly suitable for blending fuel continuous fuel emulsions. Alternatively, where water continuous emulsions are desired, the additives could be first combined with the water and subsequently mixed with the hydrocarbon. The blending system further includes an emulsification station downstream of the blending stations which is adapted to emulsify the mixture of hydrocarbon fuel, additives and water to yield a stable aqueous fuel emulsion. The present embodiment of the blending system is operatively associated with a blending system controller which is adapted to govern the flow of the hydrocarbon fuel, water and aqueous fuel emulsion additives thereby controlling the mixing ratio in accordance with prescribed blending ratios.

BRIEF DESCRIPTION OF THE DRAWINGS

The above and other aspects, features, and advantages of the present invention will be more apparent from the following, more descriptive description thereof, presented in conjunction with the following drawings, wherein.

Corresponding reference numbers indicate corresponding components throughout the different embodiments depicted in the drawings.

DETAILED DESCRIPTION OF THE INVENTION

The following description is of the best mode presently contemplated for carrying out the invention. This description is not to be taken in a limiting sense, but is made merely for the purpose of describing the general principals of the invention. The scope and breadth of the invention should be determined with reference to the claims.

Figure 1:
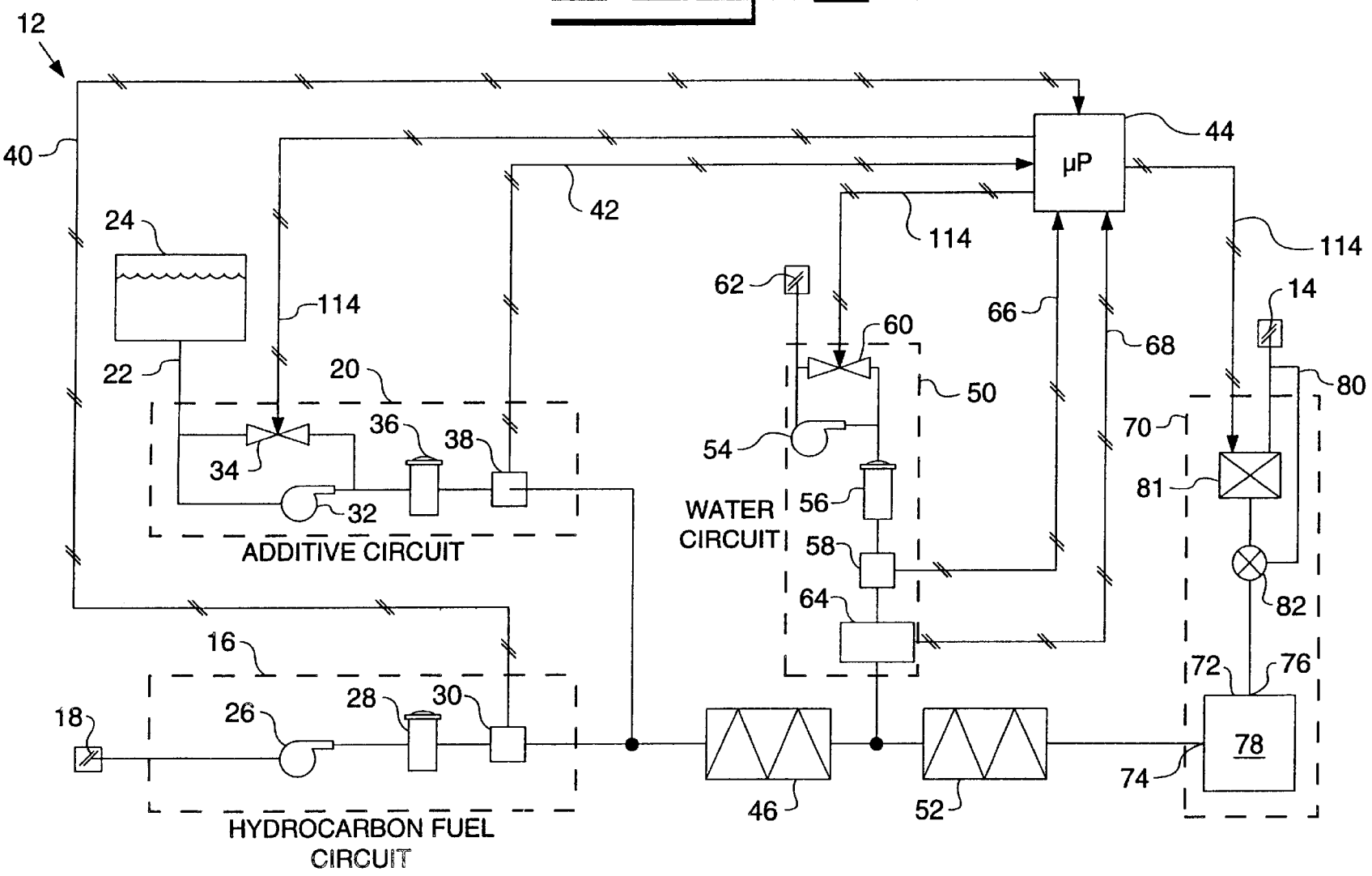
FIG. 1 is a schematic representation of the aqueous fuel emulsion blending station in accordance with the present invention.

Turning now to the drawings and particularly to FIG. 1 there is shown a schematic representation of an aqueous fuel emulsion blending system 12 having a plurality of ingredient inlets and an aqueous fuel emulsion outlet 14. As seen therein, the preferred embodiment of the fuel blending system 12 comprises a first fluid circuit 16 adapted for receiving hydrocarbon fuel at a first ingredient inlet 18 from a source of hydrocarbon fuel (not shown) and a second fluid circuit 20 adapted for receiving fuel emulsion additives at a second ingredient inlet 22 from an additive storage tank 24 or similar such source of fuel emulsion additives. The first fluid circuit 16 includes a fuel pump 26 for transferring the hydrocarbon fuel, preferably a diesel fuel (although other hydrocarbon fuels can be used), from the source of hydrocarbon fuel to the blending system 12 at a selected flow rate, a 2 to 10 micron filter 28, and a flow measurement device 30 adapted to measure the flow rate of the incoming hydrocarbon fuel stream. The second fluid circuit 20 also includes a pump 32 for transferring the additives from the storage tank 24 to the blending system 12 at prescribed flow rates. The fuel additive flow rate within the second fluid circuit 20 is controlled by a flow control valve 34 interposed between the additive storage tank 24 and the pump 32. As with the first fluid circuit 16, the second fluid circuit 20 also includes a 2 to 10 micron filter 36 and a flow measurement device 38 adapted to measure the controlled flow rate of the incoming additive stream. The signals 40,42 generated from the flow measurement devices 30,38 associated with the first and second fluid circuits are further coupled as inputs to a blending system controller 44.

The first fluid circuit 16 transporting the hydrocarbon fuel and the second fluid circuit 20 adapted for supplying the fuel additives are coupled together and subsequently mixed together using a first in-line mixer 46. The resulting mixture of hydrocarbon fuel and fuel additives is then joined with a purified water stream supplied via a third fluid circuit 50 and subsequently mixed together using a second in-line mixer 52.

The third fluid circuit 50 includes a water pump 54 for transferring the purified water from a source of clean or purified water (not shown) at a selected flow rate to the blending system 12, a particulate filter 56 and a flow measurement device 58 adapted to measure the flow rate of the incoming purified water stream. The water pump 54, filter 56 and flow measurement device 58 are serially arranged within the third fluid circuit 50. The water flow rate within the third fluid circuit 50 is preferably controlled using a flow control valve 60 interposed between the clean water source and the water pump 54 proximate the third or water inlet 62. The third fluid circuit 50 also includes a specific conductance measurement device 64 disposed downstream of the flow measurement device 58 and adapted to monitor the quality of the water supplied to the blending system 12. The signals 66,68 generated from the flow measurement device 58 and the specific conductance measurement device 64 or other suitable measurement device in the third fluid circuit 50 are provided as inputs to the blending system controller 44. If the water quality is too poor or below a prescribed threshold, the blending system controller 44 disables the blending system 12 until corrective measures are taken. In the preferred embodiment, the water quality threshold, as measured using the specific conductance measurement device 64, should be no greater than 20 microsiemens per centimeter. As indicated above, the purified water from the third fluid circuit 50 is joined with the hydrocarbon fuel and fuel additive mixture and subsequently re-mixed using the second in-line mixer 52 or equivalent blending station equipment.

The resulting mixture or combination of hydrocarbon fuel, fuel emulsion additives, and purified water are fed into an emulsification station 70. The emulsification station 70 includes an aging reservoir 72 and high shear mixing apparatus. The aging reservoir 72 includes an inlet 74, an outlet 76 and a high volume chamber 78 or reservoir. The preferred embodiment of the blending system 12 operates using an aging time that is a function of emulsion temperature. For example, a three minute aging time would be appropriate for room temperature mixture of the aqueous fuel emulsion. Thus, in the three minute aging time a blending system operating at an output flow rate of about 15 gallons per minute would utilize a 45 gallon tank as an aging reservoir.

The incoming stream of hydrocarbon fuel, fuel emulsion additives, and purified water are fed into the aging reservoir 72 at a location that preferably provides continuous agitation to the reservoir. Alternatively, the aging reservoir could include a mechanical mixing device associated therewith. The preferred embodiment of the blending system 12 also includes a continuous rotor-stator dispersion mill 81, such as the Kady Infinity model manufactured by Kady International in Scarborough, Me., disposed downstream of the aging reservoir 72 which provides the final fuel emulsion at the blending system outlet 14.

Figure 2:
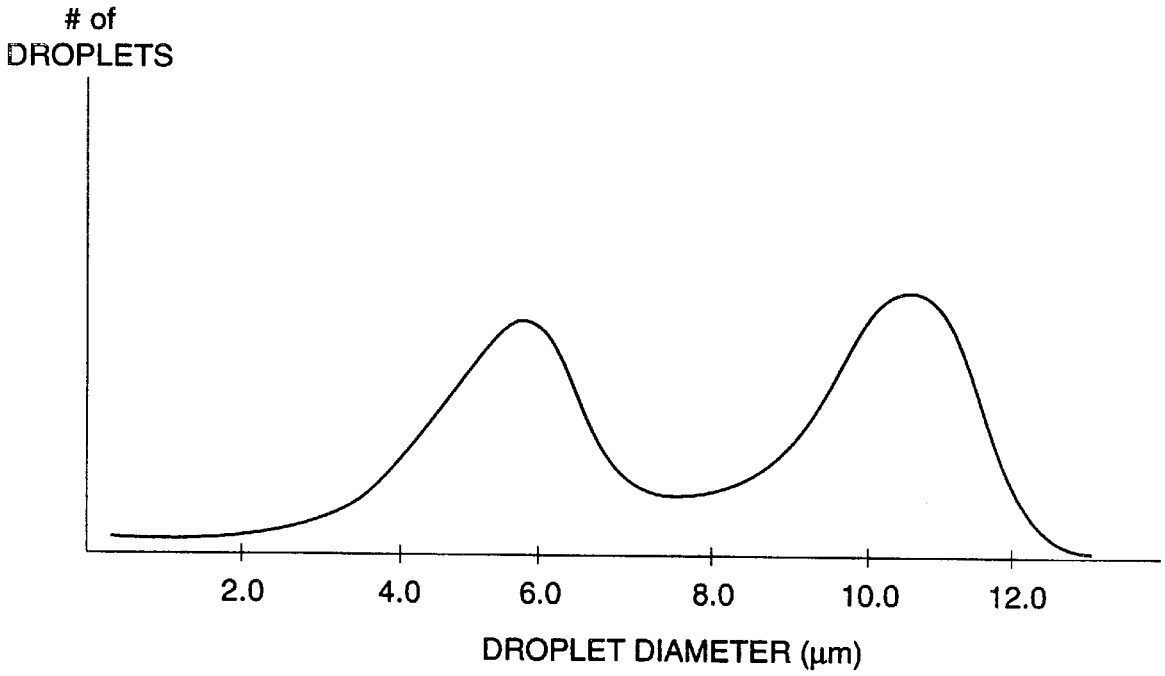
FIG. 2 is a graph that depicts the preferred droplet size distribution for a water continuous fuel emulsion prepared using the disclosed fuel emulsion blending system.
Figure 3:
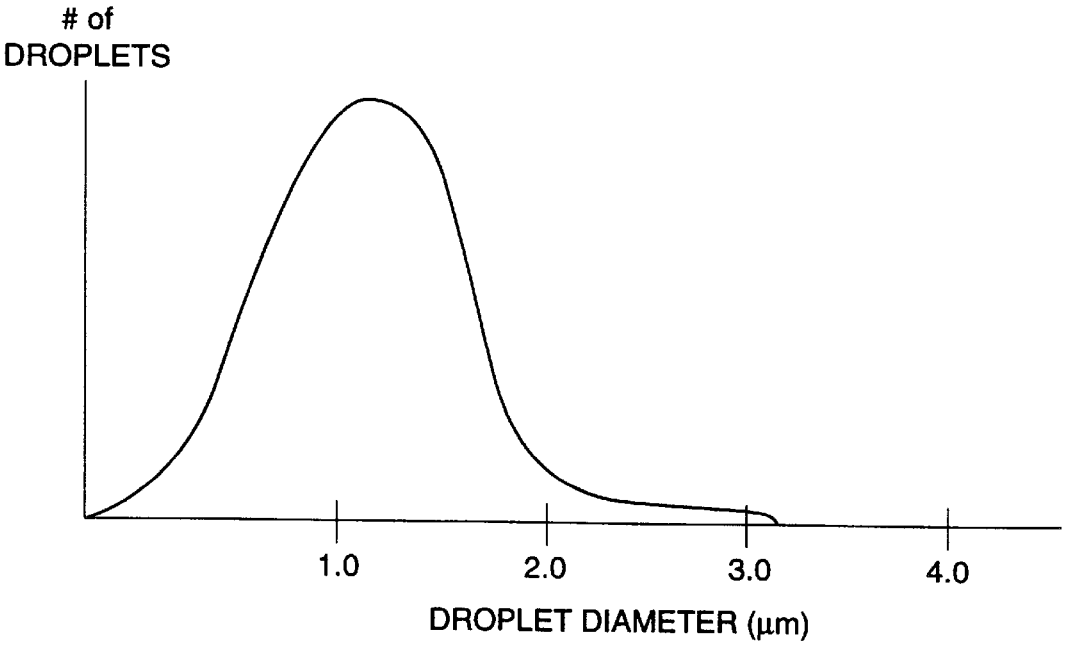
FIG. 3 is a graph that depicts the preferred droplet size distribution for an oil continuous fuel emulsion.

For optimum viscosity and stability in a water continuous fuel emulsion, a prescribed percentage of the fuel mixture flow (i.e. 10–50%) should bypass the dispersion mill 81. Such bypass flow can be accomplished using a bypass conduit 80 and associated valve 82 located within or near the emulsification station 70. Bypassing a prescribed percentage of the mixture flow around the dispersion mill 81 yields a final fuel emulsion having a bi-modal droplet size distribution, as generally represented in FIG. 2. Conversely, to achieve optimum viscosity and stability in an oil continuous fuel emulsion, all of the fuel mixture flow should be directed through the dispersion mill 81 or similar such high shear mixing device, such as a Ross X-series Mixer Emulsifier. which results in the final fuel emulsion having a droplet size distribution, as generally represented in FIG. 3.

As indicated above, the blending system controller 44 accepts as inputs the signals generated by the various flow measurement devices in the first, second and third fluid circuits, as well as any signals generated by the water quality measurement device together with various operator inputs such as prescribed fuel mix ratios and provides control signals for the flow control valve in the second fluid circuit and the flow control valve in the third fluid circuit. The illustrated embodiment of the blending system is preferably configured such that the hydrocarbon fuel stream is not precisely controlled but is precisely measured. Conversely, the purified water feed line and the fuel additive feed line are precisely controlled and precisely measured to yield a prescribed water blend fuel mix. The illustrated embodiment also shows the hydrocarbon fuel, purified water and fuel additive streams to be continuous feed so that the proper fuel blend ratio is continuously delivered to the shear pump. Alternatively, however, it may be desirable to configure the blending system such that the purified water stream is precisely measured but not precisely controlled while precisely controlling and measuring the hydrocarbon fuel feed line and the fuel additive feed line to yield a prescribed water blend fuel mix.

The above-described blending system is particularly suited for preparing a water blend fuel or aqueous fuel emulsion that uses a hydrocarbon fuel having a specific gravity in the range of about 0.70to 0.90 and a viscosity in the range of about 1.0 to 30.0 cSt. The preferred volumetric ratio of hydrocarbon fuel is between about 50% to 90% of the total volume of the aqueous fuel emulsion. Accordingly, the preferred volumetric ratio of purified water is between about 10% to 50% of the total volume of the aqueous fuel emulsion whereas the volumetric ratio of additives is between about 0.5% to 10.3% of the total volume of aqueous fuel emulsion. As indicated above, hydrocarbon fuel is preferably a diesel fuel although alternative hydrocarbon fuels such as naphtha, gasoline, synthetic fuels or combinations thereof could also be used as the base hydrocarbon fuel. The fuel emulsion additives used in the above described blending system may include one or more of the following ingredients including surfactants, emulsifiers, detergents, defoamers, lubricants, corrosion inhibitors, and anti-freeze inhibitors such as methanol. Collectively, the additives have a specific gravity in the range of about 0.80 to 0.90 and a viscosity of about 0.8 cSt.

Figure 4:
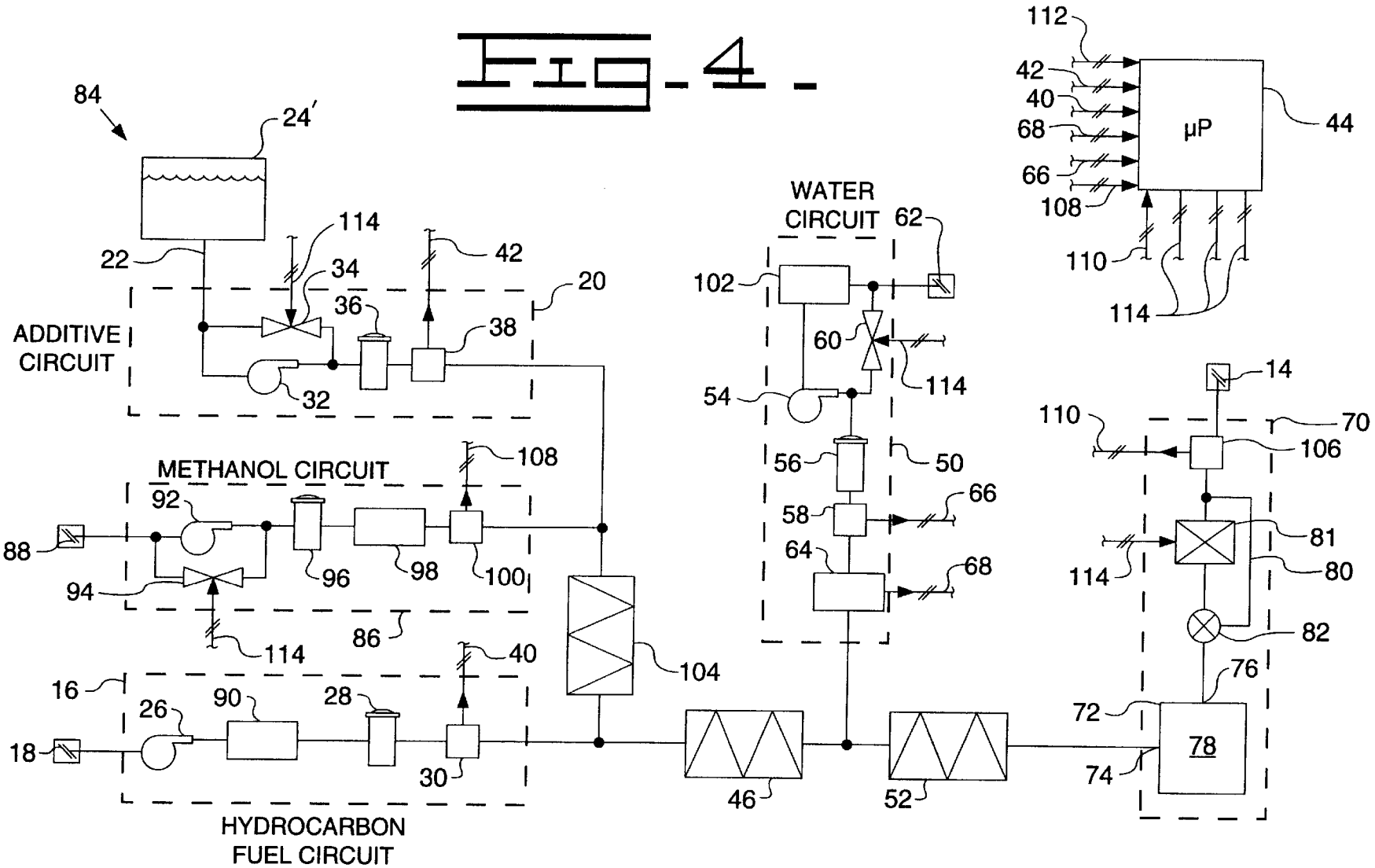
FIG. 4 is a schematic representation of an alternate embodiment of the aqueous fuel emulsion blending station in accordance with the present invention.

Turning now to FIG. 4, there is shown a schematic representation of an alternate embodiment of the fuel emulsion blending system 84. In many respects the embodiment of FIG. 4 is similar to the embodiment of FIG. 1 except for the inclusion of a fourth fluid circuit 86 and several other features of the fuel emulsion blending system 84 described herein. Much of the detailed description of many of the components or elements common to both embodiments are provided above with reference to FIG. 1 and thus will not be repeated here.

The fuel emulsion blending system 84 illustrated in FIG. 4 includes four fluid circuits inlets 18,22,62,88 and a fuel emulsion outlet 14. As described with reference to FIG. 1, the first fluid circuit 16 is adapted for receiving hydrocarbon fuel at the first ingredient inlet 18 from a source of hydrocarbon fuel (not shown) while the second fluid circuit 20 is adapted for receiving fuel emulsion additives at a second ingredient inlet 22 from an additive storage tank 24', preferably a heated source of fuel emulsion additives. The third fluid circuit 50 is adapted for receiving water at the third ingredient inlet 62 from a source of water (not shown) while the fourth fluid circuit 86 is adapted for receiving methanol at the fourth ingredient inlet 88 from an appropriate source of methanol (not shown).

As described above, the first fluid circuit 16 includes a fuel pump 26 for transferring the hydrocarbon fuel, preferably a diesel fuel, from the source of hydrocarbon fuel to the blending system 84 at a selected flow rate, a filter 28, and a flow measurement device 30 adapted to measure the flow rate of the incoming hydrocarbon fuel stream. In addition, the first fluid circuit 16 includes a heater 90 or other means for heating the hydrocarbon fuel component to a specified minimum temperature (e.g. 10 degrees C.). Likewise, the second fluid circuit 20 also includes a pump 32 for transferring the fuel emulsion additives from the storage tank 24' where the additives are maintained at a specified minimum temperature to the blending system 84 at a prescribed flow rate. The fuel additive flow rate within the second fluid circuit 20 is controlled by a flow control valve 34 interposed between the additive storage tank 24' and the fuel emulsion additive pump 32. As with the first fluid circuit 16, the second fluid circuit 20 also includes a filter 36 and a flow measurement device 38 adapted to measure the flow rate of the incoming additive stream.

The fourth fluid circuit 86 includes a pump 92 and flow control valve 94, filter 96, heating element 98 and a flow measurement device 100. The pump 92, filter 96, heater 98, and flow measurement device 100 are serially arranged within the fourth fluid circuit 86. The methanol, ethanol or other antifreeze flow rate within the fourth fluid circuit 86 is preferably controlled using the flow control valve 94 which is interposed between the methanol source (not shown) and the pump 92 proximate the fourth ingredient inlet 88. The final or third fluid circuit 50 is the water fluid circuit which preferably includes a water purification system 102 such as a reverse osmosis purification system that heats and purifies the supplied water to prescribed temperatures and levels of purity, respectively. This third fluid circuit 50 also includes a water pump 54 and water flow control valve 60 for transferring the purified water at a selected flow rate to the blending system 84. As with the earlier described embodiment, the third fluid circuit 50 also includes a flow measurement device 58 adapted to measure the flow rate of the incoming purified water stream and a specific conductance measurement device 64 or other suitable measurement devices adapted to monitor the quality of the water supplied to the blending system 84.

The operation of the fuel emulsion blending system 84 illustrated in FIG. 4, involves selective mixing of the ingredients from each of the fluid circuits. Specifically, the fourth fluid circuit 86 transporting the methanol and the second fluid circuit 20 adapted for supplying the fuel additives are coupled together and subsequently mixed together using an in-line mixer 104. The resulting mixture of methanol and fuel additives is then joined with the first fluid circuit 16 supplying the hydrocarbon fuel component. Another in-line mixer 46 is used to mix the hydrocarbon fuel, fuel additives and methanol together. The purified water stream supplied via a third fluid circuit 50 is then added to the mixture and subsequently mixed together using yet another in-line mixer 52. The resulting mixture or combination of hydrocarbon fuel, fuel emulsion additives, methanol and purified water are fed into an emulsification station 70. The emulsification station 70 includes the aging reservoir 72, and also includes a continuous rotor-stator dispersion mill 81, such as the Kady Infinity Dispersion Mill disposed downstream of the aging reservoir 72 which provides the final aqueous fuel emulsion at the blending system outlet 14. Proximate the fuel emulsion outlet 14, there is disposed a final fuel emulsion density, viscosity, conductivity and/or opacity measurement device 106 which monitors the density and/or viscosity of the final fuel blend.

The signals 40,42,66,108 generated from the flow measurement devices associated with the four fluid circuits together with the signals 68,110 generated by the specific conductance measurement device 64 in the third fluid circuit 50 and the final emulsion density, opacity, conductance and/or viscosity measurement device 106 are provided as inputs to the blending system controller 44. The blending system controller 44 also accepts various operator inputs 112 such as prescribed fuel mix ratios and provides output control signals 114 for the flow control valves 34,60,94 in the second, third and fourth fluid circuits and, if appropriate the emulsification station 70.

From the foregoing, it should be appreciated that the present invention thus provides a fuel emulsion blending system for blending an aqueous fuel emulsion from a source of hydrocarbon fuel, a source of water, and a source of fuel emulsion additives, including methanol. While the invention herein disclosed has been described by means of specific embodiments and processes associated therewith, numerous modifications and variations can be made thereto by those skilled in the art without departing from the scope of the invention as set forth in the claims or sacrificing all its material advantages.

What is claimed is:

1. A fuel emulsion blending system for blending a fuel emulsion from a source of hydrocarbon fuel, a source of water, and a source of fuel emulsion additives, said fuel emulsion blending system comprising:

a first fluid circuit adapted for receiving hydrocarbon fuel from said source of hydrocarbon fuel;

a second fluid circuit adapted for receiving fuel emulsion additives from said source of fuel emulsion additives;

a first blending station in flow communication with said first fluid circuit, said first blending station adapted to mix said hydrocarbon fuel and said fuel emulsion additives;

a third fluid circuit adapted for receiving water from said source of water;

a second blending station in flow communication with said first blending station and said third fluid circuit, said second blending station adapted to mix said hydrocarbon fuel and additive mixture from said first blending station together with said water;

an emulsification station in flow communication with said second blending station, said emulsification station adapted to emulsify said hydrocarbon fuel, fuel emulsion additives and water mixture to yield said fuel emulsion; and an outlet in flow communication with said emulsification station.

2. The fuel emulsion blending system of claim 1 wherein said emulsification station further comprises an aging reservoir in flow communication with said second blending station, said aging reservoir adapted for receiving and retaining said hydrocarbon fuel, fuel emulsion additive and water mixture for a prescribed duration.

3. The fuel emulsion blending system of claim 2 wherein said emulsification station further comprises a high shear mixer in flow communication with said aging reservoir and adapted to further emulsify said hydrocarbon fuel, fuel emulsion additive and water mixture.

4. The fuel emulsion blending system of claim 1 wherein said first blending station further comprises:

a hydrocarbon fuel inlet disposed in flow communication with said first fluid circuit;

an additive inlet disposed in flow communication with said second fluid circuit;

a mixer adapted to mix said hydrocarbon fuel received at said hydrocarbon fuel inlet with said fuel emulsion additives received at said additive inlet; and a first blending station outlet disposed in flow communication with and downstream of said mixer.

5. The fuel emulsion blending system of claim 1 wherein said second blending station further comprises:

a second blending station inlet disposed in flow communication with said first blending station outlet;

a water inlet disposed in flow communication with said third fluid circuit;

a mixer adapted to mix said hydrocarbon fuel and additive mixture received at said second blending station inlet with said water received at said water inlet; and a second blending station outlet disposed in flow communication with and downstream of said mixer.

6. The fuel emulsion blending system of claim 1 further comprising a blending system controller operatively associated with one or more fluid circuits and adapted for controlling the mixing ratio of said hydrocarbon fuel, said fuel emulsion additives, and said water.

7. The fuel emulsion blending system of claim 6 wherein said first fluid circuit further includes a flow measuring device disposed in operative association with said first fluid circuit and adapted for measuring the flow of said hydrocarbon fuel through said first fluid circuit.

8. The fuel emulsion blending system of claim 7 wherein said first fluid circuit further includes a flow control device adapted for adjusting the flow of said hydrocarbon fuel through said first fluid circuit in response to a fuel control signal received from said blending system controller.

9. The fuel emulsion blending system of claim 1 wherein said first fluid circuit further includes a first heater adapted for heating said hydrocarbon fuel to a prescribed temperature.

10. The fuel emulsion blending system of claim 6 wherein said second fluid circuit further includes a flow measuring device disposed in operative association with said second fluid circuit and adapted for measuring the flow of said fuel emulsion additives through said second fluid circuit.

11. The fuel emulsion blending system of claim 10 wherein said second fluid circuit further includes a flow control device adapted for adjusting the flow of said fuel emulsion additives through said second fluid circuit in response to a control signal received from said blending system controller.

12. The fuel emulsion blending system of claim 6 wherein said third fluid circuit further includes a flow measuring device disposed in operative association with said third fluid circuit and adapted for measuring the flow of said water through said third fluid circuit.

13. The fuel emulsion blending system of claim 12 wherein said third fluid circuit further includes a flow control device adapted for adjusting the flow of said water through said third fluid circuit in response to a water control signal received from said blending system controller.

14. The fuel emulsion blending system of claim 1 wherein said third fluid circuit further includes a water purification unit for purifying said water to a prescribed purity level.

15. The fuel emulsion blending system of claim 1 wherein said third fluid circuit further includes a water conductivity sensor disposed in operative association with said third fluid circuit and adapted for measuring the purity of said water flowing through said third fluid circuit.

16. A fuel emulsion blending system for blending a fuel emulsion from a source of hydrocarbon fuel, a source of water, and a source of fuel emulsion additives, said fuel emulsion blending system comprising:

a first fluid circuit adapted for receiving hydrocarbon fuel from said source of hydrocarbon fuel;

a second fluid circuit coupled to said first fluid circuit, said second fluid circuit adapted for receiving fuel emulsion additives from said source of fuel emulsion additives;

a third fluid circuit coupled to at least one of the first fluid circuit or second fluid circuit and adapted for receiving water from said source of water;

an aging reservoir in flow communication with said fluid circuits and adapted for holding said hydrocarbon fuel, fuel emulsion additive and water mixture for a prescribed duration;

a high shear mixer in flow communication with said aging reservoir and adapted to further emulsify said hydrocarbon fuel, fuel emulsion additive and water mixture; and an outlet in flow communication with said high shear mixer.

17. The fuel emulsion blending system of claim 16 wherein said fuel emulsion is an oil continuous fuel emulsion.

18. The fuel emulsion blending system of claim 16 further comprising a bypass conduit in flow communication between said aging reservoir with said outlet wherein a prescribed volume of said hydrocarbon fuel, fuel emulsion additive and water mixture bypasses the high shear mixer.

19. The fuel emulsion blending system of claim 18 wherein said fuel emulsion is a water continuous fuel emulsion.

20. A method for blending a fuel emulsion from a source of hydrocarbon fuel, a source of water, and a source of fuel emulsion additives comprising the steps of:

(a) receiving a flow of hydrocarbon fuel from said source of hydrocarbon fuel;

(b) receiving a flow of fuel emulsion additives from said source of fuel emulsion additives;

(c) mixing said hydrocarbon fuel and said fuel emulsion additives to yield a hydrocarbon fuel and additive mixture;

(d) receiving water from said source of water;

(e) mixing said hydrocarbon fuel and additive mixture with said water; and (f) emulsifying said hydrocarbon fuel, fuel emulsion additives and water mixture to yield said fuel emulsion.

21. The method of claim 20 further comprising the step of aging said hydrocarbon fuel, fuel emulsion additives and water mixture for a prescribed duration prior to emulsifying said hydrocarbon fuel, fuel emulsion additives and water mixture to yield said fuel emulsion.

22. The method of claim 20 further comprising the step of measuring the flow of hydrocarbon fuel, fuel emulsion additives and water.

23. The method of claim 22 further comprising the step of controlling the flow of one or more of said hydrocarbon fuel, fuel emulsion additives, and water in response to a fuel control signal received from a controller.

24. The method of claim 20 further comprising the step of heating one or more of said hydrocarbon fuel, fuel emulsion additives and water to a prescribed temperature.

* * * * *